United States Patent [19]

Tsutomu et al.

[11] 4,347,284

[45] Aug. 31, 1982

[54] WHITE COVER SHEET MATERIAL CAPABLE OF REFLECTING ULTRAVIOLET RAYS

[75] Inventors: Obayashi Tsutomu, Tokyo; Endou Mituo, Souka, both of Japan

[73] Assignee: Hiraoka & Co., Ltd., Tokyo, Japan

[21] Appl. No.: 203,137

[22] Filed: Nov. 3, 1980

[51] Int. Cl.[3] ..... B32B 5/16; B32B 15/08; G01S 7/36

[52] U.S. Cl. ..... 428/328; 343/18 R; 343/18 B; 428/409; 428/697; 428/702; 428/919; 428/921

[58] Field of Search ..... 428/409, 919, 921, 328, 428/702, 469, 697; 343/18 R, 18 A, 18 B

[56] References Cited

U.S. PATENT DOCUMENTS

| | | | |
|---|---|---|---|
| 4,001,827 | 1/1977 | Wallin et al. | 428/919 X |
| 4,064,305 | 12/1977 | Wallin | 428/919 X |
| 4,215,168 | 7/1980 | Yonemura et al. | 428/469 X |

*Primary Examiner*—Thomas J. Herbert, Jr.
*Attorney, Agent, or Firm*—Benasutti Associates, Ltd.

[57] ABSTRACT

A white cover sheet material capable of reflecting ultraviolet rays, comprises at least one outer surface layer thereof which comprises (A) a substantially colorless matrix material comprising a thermoplastic polymer material and (B) a white ultraviolet ray-reflecting agent comprising $ZrO_2$, the cover sheet material being difficult to be distinguished from snow surface not only by naked eye, but also, by an ultraviolet ray inspecting device.

20 Claims, No Drawings

WHITE COVER SHEET MATERIAL CAPABLE OF REFLECTING ULTRAVIOLET RAYS

FIELD OF THE INVENTION

The present invention relates to a white cover sheet material capable of reflecting ultraviolet rays. More particularly, the present invention relates to a white cover sheet material which exhibits an excellent reflectivity to ultraviolet rays, similar to that of snow.

BACKGROUND OF THE INVENTION

It is well-known that in order to conceal things and persons, in an area covered with snow, from inspection with the naked eye, they are covered with a white sheet material. Also, it is well-known that in order to provide the white cover sheet material, a conventional white pigment, for instance, titanium dioxide, may be used. However, the conventional white pigments have a property such that they absorb most of the incidental ultraviolet rays and hardly reflect the incidental ultraviolet rays, while snow reflects 70 to 90% of incidental ultraviolet rays. For this reason, when the conventional white sheet material placed on snow is scanned, by using an ultraviolet ray-sensitive inspecting means for instance, a special camera equipped with a filter permeable for ultraviolet rays or another special device, for example, a spectrophotometer, the conventional white cover sheet material is easily and clearly distinguished from the snow surface.

Accordingly, when the ultraviolet ray inspection is applied, the conventional white sheet cannot conceal materials or people placed on snow.

SUMMARY OF THE INVENTION

An object of the present invention is to provide a white cover sheet material capable of reflecting ultraviolet rays, and hardly distinguishable from the snow surface not only by the naked eye, but also, by an inspection means in which ultraviolet rays are applied.

The above object can be attained by using the white cover sheet material capable of reflecting ultraviolet rays of the present invention which comprises at least one outer surface layer which comprises (A) a substantially colorless matrix material comprising at least one thermoplastic polymer material and, (B) a white ultraviolet ray-reflecting agent dispersed in said matrix material and comprising at least one member selected from the group consisting of zirconium oxide ($ZrO_2$), barium sulfate ($BaSO_4$), magnesium oxide (MgO) and magnesium carbonate ($MgCO_3$).

DETAILED DESCRIPTION OF THE INVENTION

In the white cover sheet material of the present invention, it is essential that at least one outer surface of the sheet material is capable of reflecting ultraviolet rays. For this purpose, at least one outer surface layer of the cover sheet material comprises:

(A) a substantially colorless matrix material and, (B) a white ultraviolet ray-reflecting agent dispersed in the matrix material.

The matrix material comprises at least one substantially colorless thermoplastic polymer material selected from, for instance, natural rubber; synthetic rubbers, for example, polybutadiene, butadiene-styrene compolymers, butadieneacrylonitrile copolymers, polychloroprene, polyisoprene, polyisobutylene, isobutylene-isoprene copolymers, acrylic ester copolymers, polyurethane rubbers and chlorosulfonated polyethylene, and; thermoplastic synthetic resins, for example, polyvinyl chloride, polyethylene, polypropylene, ethylene-vinyl acetate copolymers, vinyl chloride-vinyl acetate copolymers, and polyurethane. Polyvinyl chloride is preferred as a matrix material. The matrix material may contain any additives such as plasticizers, stabilizers, and fillers unless the additives hinder the intended object of the present invention.

The white ultraviolet ray-reflecting agent is selected from the group consisting of zirconium oxide, barium sulfate, magnesium oxide and magnesium carbonate.

In the outer surface layer, it is preferable that the amount of the white ultraviolet ray-reflecting agent is in a range of from 20 to 200%, based on the weight of the matrix material. Preferably, the magnesium oxide is in a range of from 20 to 70%, the magnesium carbonate is in a range of from 20 to 100% and the barium sulfate is in a range of from 70 to 150% based on the weight of the matrix material.

When the amount of the white ultraviolet ray-reflecting agent is less than 20%, sometimes, the resultant cover sheet material exhibits an unsatisfactory reflectivity for ultraviolet rays and an insufficient shading effect for visible light. Accordingly, it is difficult to conceal materials and/or people by covering then with the sheet material. When the amount of the white ultraviolet ray-reflecting agent is more than 200%, the resultant outer surface layer sometimes exhibits a poor flexibility and becomes easily cracked at a low temperature. Also, in the amount of the white ultraviolet ray-reflecting atent more than 200%, the increase in its amount causes the reflectivity of the resultant outer surface to the ultraviolet rays to very slightly increase. Accordingly, usually, the ultraviolet ray-reflecting agent is used in an amount of 20 to 200% based on the weight of the matrix material.

Also, it is preferable that the white ultraviolet ray-reflecting agent is in the form of fine particles. Furthermore, it is preferable that the fine particles have a 100 mesh size or smaller. That is, the preferable fine particles can pass through a 100 mesh sieve, and more preferably, a 350 mesh sieve.

The outer surface layer capable of reflecting ultravilet rays, may be in the form of a film or a fiber fabric. Also, the sheet material of the present invention may be composed of the outer surface layer capable of reflecting ultraviolet rays alone, or a substrate sheet layer and at least one outer surface layer capable of reflecting ultraviolet rays.

The fine particles of the white ultraviolet ray-reflecting agent are uniformly dispered in the matrix material by using a conventional mixing apparatus, for instance, calender mixer, Bumbury's mixer or screw extruder.

When the cover sheet material of the present invention is composed of the outer surface layer containing the white ultraviolet ray-reflecting agent, the mixture of the white ultraviolet ray-reflecting agent with the matrix material is formed into a sheet having desired dimensions by means of a conventional sheet forming apparatus, for example, a calender or extruder. The thickness of the sheet is not limited to a special range of values. However, usually, the thickness of the sheet is 0.05 mm or more, preferably, 0.1 mm or more.

In the case where the outer surface layer containing the white ultraviolet ray-reflecting agent is formed on a surface of a substrate sheet layer, the substrate sheet may be selected from fiber fabrics, for example, woven, knitted or non-woven fabric, and polymeric sheets or films.

The fiber fabric may be made from continuous filament yarns, staple fiber spun yarns, split fiber yarns or tape yarns. The fiber may be a natural organic fiber such as cotton or wool; inorganic fiber such as glass fiber; organic synthetic fiber such as polyester, polyamide, polyacronitrile or water-insolubized or sparingly water-soluble modified polyvinyl alcohol fiber; regenerated fiber such as viscose or cupra fiber and; semi-synthetic fiber such as cellulose acetate fiber. It is preferable that the substrate fiber fabric is made of polyester, polyamide or modified polyvinyl alcohol filaments or staple fibers. Especially, it is preferable that the substrate fiber fabric consists of the water-isoluble or sparingly water-soluble polyvinyl alcohol filaments or fibers. This type of fiber fabric exhibits an excellent reflectivity of 60 to 70% to ultraviolet rays having a wave length of from 300 to 400 millimicrons. When this type of fiber fabric is employed as a substrate fiber fabric, it becomes possible to reduce the amount of the ultraviolet ray-reflecting agent to be contained in the white outer surface layer. Also, since the reflectivity of the modified polyvinyl alcohol substrate fiber fabric does not decrease by being repeatedly washed or laundered, the ultraviolet ray-reflecting effect on the substrate fiber fabric can be maintained constant even if the cover sheet material is subjected to repeated washing or laundering procedures.

In the case where the substrate sheet material is composed of a polymeric sheet or film, the sheet or film may be made of natural rubber; synthetic rubber, for example, polybutadiene, butadiene-styrene copolymer, butadieneacrylonitrile copolymer, polychloroprene, polyisoprene, polyisobutylene, isobutyleneisoprene copolymer, acrylic ester copolymer, polyurethene rubber, or chlororulfonated polyethylene, or; thermoplastic synthetic polymer, for example, polyvinyl chloride, polyethylene, polypropylene, ethylene-vinyl acetate copolymer, vinyl chloride-vinyl acetate copolymer, or polyurethane.

The substrate sheet material preferably has a substantially colorless surface on which the outer surface layer having the ultraviolet ray-reflecting property is formed. The substrate sheet material may comprise at least one substantially colorless surface layer formed on at least one surface of a supporting sheet material.

The substantially colorless surface layer may comprise a substantially colorless matrix material comprising at least one thermoplastic polymer material and titanium dioxide dispersed in the matrix material. The amount of the titanium dioxide is preferably in a range of from 2 to 50%, more preferably, from 3 to 20%, based on the matrix material. The titanium dioxide is in the form of fine particles preferably having a size of 1.0 micron or less, more preferably, from 0.2 to 0.6 microns. The titanium dioxide may be either of a rutile type or of anatase. In regard to whiteness and ultraviolet ray-reflecting properties, the anatase type of titanium oxide is preferable for the present invention.

The thermoplastic polymer matrix material in the substrate sheet material may be selected from the polymer materials usable for the outer surface layer containing the ultraviolet ray-reflecting agent.

It is preferable that the substrate sheet material exhibits such an excellent visible light-screening property that an 8-point type cannot be seen through the substrate sheet material in accordance with the method of JIS K-68 28, 4-10-2.

The substrate sheet material may contain one or more metal foil, for example, aluminium foil, laminated with the polymeric sheet or film and/or the fiber fabric.

It is preferable that the surface of the substrate sheet material exhibits a high degree of whiteness.

In order to provide a white outer surface layer capable of reflecting ultraviolet rays, a film or sheet containing the ultraviolet ray-reflecting agent in the matrix material may be adhered to a surface of the white surface of the substrate sheet material be using a colorless adhesive or by a metl-bonding method. Otherwise, a solution or dispersion of the mixture of the ultraviolet ray-reflecting agent and the matrix material is a medium is applied to the white surface of the substrate sheet material or impregnated by the substrate sheet material and, then, the solution or dispersion is solidified by removing the medium therefrom.

The thickness of the outer surface layer is preferably in a range of from 0.05 to 0.5 mm, more preferably, from 0.1 to 0.3 mm.

The white cover sheet material of the present invention exhibits not only an excellent whiteness but also an excellent reflectivity of 70% or more, usually, from 80 to 85% to ultraviolet rays having a wave length of from 300 to 400 millimicrons. Therefore, when the white cover sheet material of the present invention is placed on a snow surface, it is difficult to distinguish it from the snow surface not only with the naked eye, but also, with the ultraviolet ray-inspecting device.

In the cover sheet material of the present invention, the outer surface layer may contain, in addition to the white ultraviolet ray-reflecting agent, a white flame-retarding agent dispersed in the matrix material. The white flame-retarding agent may be selected from conventional white flame-retarding agents unless the purpose of the present invention is hindered thereby. Usually, the white flame-retarding agent comprises diantimony trioxide which is effective for enhancing the flame-retarding property of the sheet material without decreasing the whiteness and the ultraviolet ray-reflecting property of the outer surface layer. The flame-retarding agent may be contained not only in the outer surface layer, but also, in the substrate sheet material. The amount of the flame-retarding agent, for example, diantimony trioxide, is preferably in a range of from 2 to 10%, more preferably, from 4 to 7%, based on the weight of the matrix material.

The substrate sheet material may contain an electroconductive substance which is capable of reflecting electromagnetic waves usable for radar (radio direction-finding and ranging), unless the purpose of the present invention is hindered thereby. The electric conductive substance may be selected from fine wires of metals, for example, stainless steel, copper and aluminium, carbon fibers, graphite fibers, fine particles of metals, carbon and graphite.

The cover sheet material of the present invention may have various attachments, for example, threads, tapes, ropes and the like. Needless to say, it is necessary that each of the attachments has an outer surface layer containing the white ultraviolet ray-reflecting agent.

The following specific examples are presented for the purpose of clarifying the present invention. However, it should be understood that these are intended only to be examples of the present invention and are not intended to limit the present invention in any way.

In the examples, the reflectivities of sheet materials to ultraviolet rays and visible light were measured at wave lengths of 350 to 600 millimicrons, respectively, by using a spectrophotometer (Type 607 made by Hitachi, Japan).

EXAMPLES 1 AND 2

In each of the Examples 1 and 2, a mixture having a composition as indicated in Table 1 was prepared. The mixture was kneaded and formed into a sheet having a thickness of 0.1 mm by using a calender. The resultant sheet exhibited properties indicated in Table 1.

TABLE 1

| Item | Example No. Example 1 | Example 2 |
|---|---|---|
| Composition (part by weight) | | |
| Polyvinyl chloride | 100 | 100 |
| D. O. P. | 75 | 75 |
| Zirconium oxide | 100 | 100 |
| Diantimony trioxide | 0 | 7 |
| Zinc stearate | 3 | 3 |
| Reflectivity to ultraviolet rays having a wave length of 350 mμ (%) | 82 | 80 |
| Flame retardancy (class) | 2-nd class | 1-st class |

The flame retardancy was evaluated in accordance with JIS-Z-2150-B, by heating for two minutes.

Comparative Example 1

The same procedures as those described in Example 1 were carried out, except that no zirconium oxide was used. The resultant sheet was transparent and exhibited substantially no reflectivity to ultraviolet rays having a wave length of 350 millimicrons.

Comparative Example 2

The same procedures as those described in Example 1 were carried out, except that the zirconium oxide was replaced by titanium dioxide. The resultant sheet exhibited an excellent whiteness. However, the sheet exhibited a very poor reflectivity of about 20% to ultraviolet rays having a wave length of 350 millimicrons, and, therefore, was easily distinguished from snow by means of ultraviolet ray insepction.

EXAMPLES 3 AND 4

In Example 3, the same white ultraviolet ray-reflecting sheet as that described in Example 1 was heat-bonded to a surface of a substrate woven fabric consisting of polyvinyl alcohol continuous filament yarns which had been modified by reacting with formaldehyde and which had the following structure:

$$\frac{\text{240 denier/single yarn} \times \text{240 denier/single yarn}}{\text{29 yarns/25.4 mm} \times \text{28 yarns/25.4 mm}}$$

The resultant composite sheet had a thickness of 0.22 mm and exhibited a reflectivity of 85% to ultraviolet rays having a wave length of 350 millimicrons and a second class flame retardancy.

In Example 4, the same procedures as those described in Example 3, except that the same white ultraviolet ray-reflecting sheet as that described in Example 2 was heat-bonded to the substrate woven fabric. The resultant composite sheet had a thickness of 0.2 mm and exhibited a reflectivity of 83% to the ultraviolet rays having a wave length of 350 millimicrons and a first class flame retardancy.

EXAMPLES 5 THROUGH 12

In each of the Examples 5 through 12, a mixture having a composition indicated in Table 2 was kneaded and formed into a sheet having a thickness of 0.1 mm by using a calender.

Both surfaces of a woven fabric consisting of polyethylene terephthalate fiber spun yarns and having a weight of 159 g/m$^2$ and the following structure:

$$\frac{20/1 \times 20/1}{92 \times 55}$$

were heat coated with the above-prepared sheet. The resultant composite sheet had a thickness of 0.58 mm and exhibited properties indicated in Table 2.

TABLE 2

| Item | Example No. 5 | 6 | 7 | 8 | 9 | 10 | 11 | 12 |
|---|---|---|---|---|---|---|---|---|
| Composition | | | | | | | | |
| Polyvinyl chloride | 100 | 100 | 100 | 100 | 100 | 100 | 100 | 100 |
| D. O. P. | 75 | 75 | 75 | 75 | 75 | 75 | 75 | 75 |
| Zinc stearate | 3 | 3 | 3 | 3 | 3 | 3 | 3 | 3 |
| $BaSO_4$ | 150 | — | — | 100 | — | 100 | 50 | 50 |
| $MgCO_3$ | — | 70 | — | — | 70 | 50 | 50 | 50 |
| MgO | — | — | 30 | — | — | — | 10 | 10 |
| $ZrO_2$ | — | — | — | 50 | 50 | — | — | — |
| $Sb_2O_3$ | 7 | 7 | 7 | 7 | 7 | 7 | 7 | — |
| Reflectivity (%) to ultraviolet rays*1 | 83 | 80 | 76 | 84 | 80 | 82 | 80 | 78 |
| Reflectivity (%) to visible light*2 | 84 | 82 | 80 | 83 | 84 | 82 | 81 | 81 |
| Light-screening property | good | good | good | good | good | good | good | good |
| Flame-retardancy (class) | 1-st | 1-st | 1-st | 1-st | 1-st | 1-st | 1-st | 2-nd |

Note:
*1Wave length: 350 millimicrons
*2Wave length: 600 millimicrons

EXAMPLES 13 THROUGH 22

Two types of white substrate sheets I and II were prepared from compositions indicated in Table 3 by using a calender.

TABLE 3

| Component | Composition (part by weight) White sheet I | White sheet II |
|---|---|---|
| Polyvinyl chloride | 100 | 100 |
| D. O. P. | 75 | 75 |
| Titanium dioxide | 8 | 8 |
| Diantimony trioxide | 0 | 7 |
| Zinc stearate | 3 | 3 |

The resultant substrate sheets I and II had a thickness of 0.1 mm.

Separately, eight types of white ultraviolet ray-reflecting sheets A through H were prepared from compositions indicated in Table 4 by using a calender.

TABLE 4

| Component | Composition (part by weight) Sheet A | Sheet B | Sheet C | Sheet D | Sheet E | Sheet F | Sheet G | Sheet H |
|---|---|---|---|---|---|---|---|---|
| Polyvinyl chloride | 100 | 100 | 100 | 100 | 100 | 100 | 100 | 100 |
| D. O. P. | 75 | 75 | 75 | 75 | 75 | 75 | 75 | 75 |
| $BaSO_4$ | 5 | 25 | 60 | 100 | 100 | — | — | — |
| $MgCO_3$ | 5 | 25 | 40 | — | — | 80 | — | — |
| $ZrO_2$ | 10 | — | — | — | — | — | 80 | — |
| MgO | 5 | — | — | — | — | — | — | 30 |
| $Sb_2O_3$ | 7 | 7 | 7 | 7 | — | 7 | 7 | 7 |
| Zinc stearate | 3 | 3 | 3 | 3 | 3 | 3 | 3 | 3 |

In each of the Examples 13 through 22, a specific substrate sheet indicated in Table 5 was heat-bonded with a white ultraviolet ray-reflecting sheet as specified in Table 5, by using a calender.

TABLE 5

| Example No. | Combination Substrate sheet | Ultraviolet ray reflecting sheet |
|---|---|---|
| 13 | II | A |
| 14 | " | B |
| 15 | " | C |
| 16 | " | D |
| 17 | " | E |
| 18 | I | D |
| 19 | I | E |
| 20 | II | F |
| 21 | II | G |
| 22 | II | H |

The resultant composite sheets each had a thickness of 0.2 mm, and exhibited properties, as indicated in Table 6.

TABLE 6

| Example No. | Reflectivity to Ultraviolet ray*1 | Reflectivity to visible light | Flame-retardance |
|---|---|---|---|
| 13 | 78 | 87 | 1-st class |
| 14 | 80 | 85 | " |
| 15 | 82 | 85 | " |
| 16 | 82 | 85 | " |
| 17 | 82 | 85 | " |
| 18 | 82 | 85 | " |
| 19 | 82 | 85 | 2-nd class |
| 20 | 84 | 85 | 1-st class |
| 21 | 85 | 88 | " |
| 22 | 78 | 80 | " |

EXAMPLE 23 THROUGH 29 AND COMPARISON EXAMPLE 3

In each of the Examples 23 through 29 and Comparison Example 3, an aqueous suspension having a composition indicated in Table 7 was prepared.

TABLE 7

| Example No. (Component) | Composition (part by weight) Example 23 | 24 | 25 | 26 | 27 | 28 | 29 | Comparison Example 3 |
|---|---|---|---|---|---|---|---|---|
| $ZrO_2$ | 50 | — | — | — | 30 | 40 | 30 | — |
| $BaSO_4$ | — | 50 | — | — | 20 | — | — | — |
| MgO | — | — | 50 | — | — | 10 | — | — |
| $MgCO_3$ | — | — | — | 50 | — | — | 20 | — |
| $TiO_2$ | — | — | — | — | — | — | — | 50 |
| Water | 100 | 100 | 100 | 100 | 100 | 100 | 100 | 100 |
| Primal HA-8*1 | 50 | 50 | 50 | 50 | 50 | 50 | 50 | 50 |

Note (1):
*1An emulsion of a polyacrylic ester having a concentration of 40% by weight
Note (2):
The viscosity of each suspension was adjusted to 2,500 c poises by using a small amount of a ammonia solution.

A plain weave fabric consisting of polyethylene terephthalate spun yarns and having a weight of 195 g/m$^2$ and the following structure:

$$\frac{20/1 \times 20/1}{92 \times 55}$$

was scoured and bleached by an ordinary process and, then, dried. The dried fabric was immersed in the above-mentioned aqueous suspension, squeezed with a mangle in such a manner that the fabric is impregnated with a portion of the suspension in an amount corresponding to about 70% of the weight of the fabric, dried at a temperature of 100° C. and, finally, heated at a temperature of 150° C. for two minutes to heat-set the fabric and the polyacrlic ester emulsion on the fabric.

The results are indicated in Table 8.

TABLE 8

| Example No. | Reflectivity (%) to ultraviolet rays (350 mμ) | Reflectivity (%) to visible light (600 mμ) |
|---|---|---|
| Example | | |
| 23 | 82 | 87 |
| 24 | 80 | 84 |
| 25 | 80 | 82 |
| 26 | 85 | 80 |
| 27 | 80 | 84 |
| 28 | 81 | 84 |
| 29 | 83 | 82 |
| Comparison | | |

TABLE 8-continued

| Example No. | Reflectivity (%) to ultraviolet rays (350 mμ) | Reflectivity (%) to visible light (600 mμ) |
|---|---|---|
| Example 3 | 10 | 90 |

EXAMPLE 30

The same procedures as those described in Example 26 were carried out, except that the aqueous suspension contained, as an additive, 10 parts by weight of dianitimony trioxide and the polyethylene terephthalate fabric was replaced by a plain weave fabric consisting of polyvinyl alcohol fiber spun yarns which had been water-insolubilized by treating it with formaldehyde, and having the following structure:

$$\frac{20/1 \times 20/1}{92 \times 55}$$

The resulting sheet exhibited a reflectivity of 87% to ultraviolet rays (350 millimicrons), and a reflectivity of 80% to visible light (600 millimicrons), and the flame retardancy of the sheet was first class.

The water-insolubilized polyvinyl alcohol fiber fabric per se exhibited a reflectivity of about 60% to ultraviolet rays (350 millimicrons).

EXAMPLE 31

The same procedures as those described in Example 30 were carried out, except that the water-insolubilized polyvinyl alcohol fiber fabric is replaced by nylon 6 fiber fabric. The results were the same as those of Example 30.

We claim:

1. A white cover sheet material capable of reflecting ultraviolet rays, which comprises:

(A) a substantially colorless matrix material comprising at least one thermoplastic polymer material and, (B) a white ultraviolet ray-reflecting agent dispersed in said matrix material and comprising zirconium oxide ($ZrO_2$).

2. A white cover sheet material as claimed in claim 1, wherein the amount of said white ultraviolet ray-reflecting agent is in a range of from 20 to 200% based on the weight of said matrix material in said sheet material.

3. A white cover sheet material as claimed in claim 1, wherein said thermoplastic polymer material is selected from the group consisting of natural rubbers, synthetic rubbers, polyvinyl chloride, polyethylene, polypropylene, ethylene-vinyl acetate copolymers, vinyl chloride-vinyl acetate copolymers and polyurethane resins.

4. A white cover sheet material as claimed in claim 1, wherein said white ultraviolet ray-reflecting agent is in the form of fine particles having an 100 mesh size or smaller.

5. A white cover sheet material as claimed in claim 1, which sheet material is in the form of a film.

6. A white cover sheet material as claimed in claim 1, which sheet material is in the form of a fiber fabric.

7. A white cover sheet material as claimed in claim 1, which sheet material further contains a white flame-retarding agent dispersed in said matrix material.

8. A white cover sheet material capable of reflecting ultraviolet rays, which comprises a substrate sheet layer and at least one outer surface layer formed on at least one surface of said substrate sheet layer, said outer surface layer comprising:

(A) a substantially colorless matrix material comprising at least one thermoplastic polymer material and, (B) a white ultraviolet ray-reflecting agent dispersed in said matrix material and comprising zirconium oxide ($ZrO_2$).

9. A white cover sheet material as claimed in claim 8, wherein said outer surface layer is in the form of a film.

10. A white cover sheet material as claimed in claim 8, wherein said outer surface layer is in the form of a fiber fabric.

11. A white cover sheet material as claimed in claim 8, wherein said substrate sheet layer comprises an electro-conductive substance effective for reflecting electromagnetic waves usable for radar.

12. A white cover sheet material as claimed in claim 8, wherein said substrate sheet layer contains a flame-retarding agent.

13. A white cover sheet material as claimed in claim 8, wherein said surface of said substrate sheet layer is substantially colorless.

14. A white cover sheet material as claimed in claim 13, wherein said substrate sheet layer comprises at least one substantially colorless surface layer formed on at least one surface of a supporting sheet material.

15. A white cover sheet material as claimed in claim 13, wherein said substantially colorless surface layer comprises a substantially colorless matrix material comprising at least one thermoplastic polymer material, and titanium dioxide dispersed in said matrix material.

16. A white cover sheet material as claimed in claim 13, wherein said substrate sheet layer is a fiber fabric.

17. A white cover sheet material as claimed in claim 16, wherein said fiber fabric exhibits a reflectivity of 60% or more for ultraviolet rays having a wave length of 360 millimicrons.

18. A white cover sheet material as claimed in claim 17, wherein said fiber fabric is comprised of polyvinyl alcohol fibers which have been modified to be water-insoluble or sparingly water-soluble.

19. A white cover sheet material as claimed in claim 8, wherein said outer surface layer contains, in addition to said white ultraviolet ray-reflecting agent, a white flame-retarding agent dispersed in said matrix material.

20. A white cover sheet material as claimed in claim 19, wherein said white flame-retarding agent is diantimony trioxide.

* * * * *